US008023877B2

(12) United States Patent
Sudo et al.

(10) Patent No.: US 8,023,877 B2
(45) Date of Patent: Sep. 20, 2011

(54) IMAGE FORMING APPARATUS CAPABLE OF FORMING GLOSSY COLOR IMAGE

(75) Inventors: Kazuhisa Sudo, Kawasaki (JP); Mikio Ishibashi, Yokohama (JP); Yukiko Iwasaki, Yokohama (JP); Megumi Ohtoshi, Yokohama (JP); Reki Nakamura, Sagamihara (JP); Masafumi Yamada, Kawasaki (JP); Nobuyuki Koinuma, Yokohama (JP); Takashi Sakamaki, Ebina (JP)

(73) Assignee: Ricoh Company Limited, Tokyo (JP)

( * ) Notice: Subject to any disclaimer, the term of this patent is extended or adjusted under 35 U.S.C. 154(b) by 904 days.

(21) Appl. No.: 11/958,054

(22) Filed: Dec. 17, 2007

(65) Prior Publication Data

US 2008/0152407 A1 Jun. 26, 2008

(30) Foreign Application Priority Data

Dec. 25, 2006 (JP) ..... 2006-348645
Dec. 25, 2006 (JP) ..... 2006-348646

(51) Int. Cl.
*G03G 15/20* (2006.01)

(52) U.S. Cl. ..... 399/341; 399/342

(58) Field of Classification Search ..... 399/341, 399/342, 407; 430/124.13, 124.52
See application file for complete search history.

(56) References Cited

U.S. PATENT DOCUMENTS 4,975,748 A 12/1990 Koinuma et al.
5,003,354 A 3/1991 Takamiya et al.
5,016,114 A 5/1991 Sakata et al.
5,270,783 A 12/1993 Bisaiji et al.
5,394,231 A 2/1995 Sudo et al.
5,592,267 A 1/1997 Misago et al.
5,606,408 A 2/1997 Yano et al.
5,619,316 A 4/1997 Shoji et al.
5,659,843 A 8/1997 Takano et al.
5,983,064 A 11/1999 Green et al.
6,014,532 A 1/2000 Takeichi et al.
6,118,964 A 9/2000 Kojima et al.
6,337,957 B1 1/2002 Tamaki et al.
6,360,065 B1 3/2002 Ishibashi et al.
6,393,241 B1 5/2002 Matsumoto et al.
6,470,161 B2 10/2002 Fujishiro et al.
6,501,913 B2 12/2002 Hattori et al.
6,505,022 B2 1/2003 Kosuge et al.
6,519,428 B1 2/2003 Ohtoshi et al.
6,522,855 B1 2/2003 Katoh et al.
6,546,219 B2 4/2003 Sato et al.
6,591,077 B2 7/2003 Yanagisawa et al.
6,628,908 B2 9/2003 Matsumoto et al.

(Continued)

FOREIGN PATENT DOCUMENTS

JP 10-278183 10/1998

(Continued)

*Primary Examiner* — David Gray
*Assistant Examiner* — Laura Roth
(74) *Attorney, Agent, or Firm* — Oblon, Spivak, McClelland, Maier & Neustadt, L.L.P.

(57) ABSTRACT

An image forming apparatus capable of using a recording medium having a transparent portion includes an image forming unit, a fixing unit, and an applicator. The image forming unit forms an image on a face of the recording medium. The fixing unit fixes the image, formed by the image forming unit, on the face of the recording medium. The applicator applies a non-transparent liquid to at least the fixed image on the face of the recording medium.

17 Claims, 9 Drawing Sheets

U.S. PATENT DOCUMENTS

| | | | |
|---|---|---|---|
| 6,665,508 | B2 | 12/2003 | Sudo et al. |
| 6,763,216 | B2 | 7/2004 | Ishibashi et al. |
| 6,775,503 | B2 | 8/2004 | Hattori et al. |
| 6,778,790 | B2 | 8/2004 | Yoshinaga et al. |
| 6,778,797 | B2 | 8/2004 | Sato et al. |
| 6,826,381 | B2 | 11/2004 | Muramatsu et al. |
| 6,873,809 | B2 | 3/2005 | Amemiya et al. |
| 7,027,747 | B2 | 4/2006 | Iwasaki et al. |
| 7,043,182 | B2 | 5/2006 | Sakai et al. |
| 7,130,558 | B2 | 10/2006 | Matsumoto et al. |
| 7,130,567 | B2 | 10/2006 | Sudo et al. |
| 7,158,742 | B2 | 1/2007 | Sudo et al. |
| 7,177,555 | B2 | 2/2007 | Shu et al. |
| 7,184,691 | B2 | 2/2007 | Kita et al. |
| 7,209,687 | B2 | 4/2007 | Sudo et al. |
| 7,212,773 | B2 | 5/2007 | Sudo et al |
| 7,272,342 | B2 | 9/2007 | Nagashima et al. |
| 2004/0246319 | A1* | 12/2004 | Ito et al. |
| 2005/0031374 | A1 | 2/2005 | Nagashima et al. |
| 2006/0032581 | A1 | 2/2006 | Sato et al. |
| 2006/0158481 | A1 | 7/2006 | Spevak et al. |
| 2006/0239701 | A1 | 10/2006 | Ishibashi |
| 2006/0239729 | A1* | 10/2006 | Okamoto ..... 399/342 |
| 2007/0058998 | A1 | 3/2007 | Ishibashi |
| 2007/0110480 | A1 | 5/2007 | Matsumoto et al. |
| 2007/0140747 | A1 | 6/2007 | Kita et al. |
| 2007/0164505 | A1 | 7/2007 | Ishibashi et al. |
| 2007/0201904 | A1 | 8/2007 | Sano et al. |
| 2007/0201905 | A1 | 8/2007 | Sano et al. |
| 2007/0212116 | A1 | 9/2007 | Itoh et al. |
| 2007/0212117 | A1 | 9/2007 | Itoh et al. |
| 2007/0212119 | A1 | 9/2007 | Kurenuma et al. |
| 2007/0242982 | A1 | 10/2007 | Sudo et al. |
| 2007/0278735 | A1 | 12/2007 | Sudo et al. |
| 2008/0025774 | A1* | 1/2008 | Ishibashi et al. ..... 399/341 |

FOREIGN PATENT DOCUMENTS

| | | |
|---|---|---|
| JP | 2002-108039 | 4/2002 |
| JP | 2002-341623 | 11/2002 |
| JP | 2004-191678 | 7/2004 |
| JP | 2004-302044 | 10/2004 |
| JP | 3945281 | 4/2007 |

* cited by examiner

IMAGE FORMING APPARATUS CAPABLE OF FORMING GLOSSY COLOR IMAGE

CROSS-REFERENCE TO RELATED APPLICATIONS

The present patent application claims priority under 35 U.S.C. §119 from Japanese Patent Application Nos. JP2006-348645 and JP2006-348646, both filed on Dec. 25, 2006 in the Japan Patent Office, the entire contents of each of which are hereby incorporated herein by reference.

BACKGROUND OF THE INVENTION

1. Field of the Invention

The present invention relates to an image forming apparatus capable of using a recording medium having a transparent portion.

2. Discussion of the Background

For an image forming apparatus used as a copier, facsimile, printer, or multi-functional device thereof, various attempts have been and are being made to obtain a glossy color image of photographic quality.

For example, a conventional image forming apparatus includes four process units serving as imaging engines to form images of, for example, yellow, magenta, cyan, and black, and additionally, another process unit having two developing devices containing white toner and transparent toner. The conventional image forming apparatus is configured as a tandem type printer, in which the process units are arranged parallel to one another.

With the conventional image forming apparatus, for example, toner images of the four colors of yellow, magenta, cyan, and black are superimposed one on top of another onto an intermediate transfer belt to form a composite color toner image thereon. Further, a white toner image and a transparent toner image are overlaid onto the composite color toner image. Consequently, the color toner image has a maximum of six toner layers.

When the color toner image is transferred onto a recording medium, a fixing device fixes the composite color toner image on the recording medium by applying heat and pressure to form a desired full-color image on the recording medium.

The base color of a recording medium may affect the tone of a finished image, degrading image quality. Alternatively, irregularities in the surface of the recording medium may degrade image quality. Hence, the conventional image forming apparatus attempts to prevent such deterioration by applying the white toner and the transparent toner as described above.

However, the conventional image forming apparatus has a cost disadvantage in that the transparent toner is applied over the entire surface of the recording medium. Moreover, differences in toner thickness between image forming areas and non-image forming areas can tax the fixing device.

In one conventional technique, a special type of recording medium is used to obtain a glossy image. Such a special recording medium has a thermoplastic resin layer on at least one face thereof. When a toner image is fixed on the recording medium in the usual manner, heat and pressure are further applied to the recording medium to obtain an image having uniform glossiness.

A conventional image forming apparatus typically includes a first fixing device and a second, specific fixing device having a very smooth belt. When the first fixing device fixes a toner image on a recording medium in the usual manner, the second fixing device melts and cools the toner image on the recording medium using the belt, thus providing an image having uniform glossiness.

However, the above-described special recording medium may need to be used together with a special fixing device to obtain such a high-gloss image. Therefore, the conventional technique may have disadvantages in terms of configuration, cost, and power consumption.

SUMMARY OF THE INVENTION

Exemplary embodiments of the present invention provide an image forming apparatus capable of forming a glossy photographic image using a relatively simple, and therefore relatively inexpensive, configuration.

In one exemplary embodiment of the present invention, an image forming apparatus capable of using a recording medium having a transparent portion includes an image forming unit, a fixing unit, and an applicator. The image forming unit forms an image on a face of the recording medium. The fixing unit fixes the image, formed by the image forming unit, on the face of the recording medium. The applicator applies a non-transparent liquid to at least the fixed image on the face of the recording medium.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
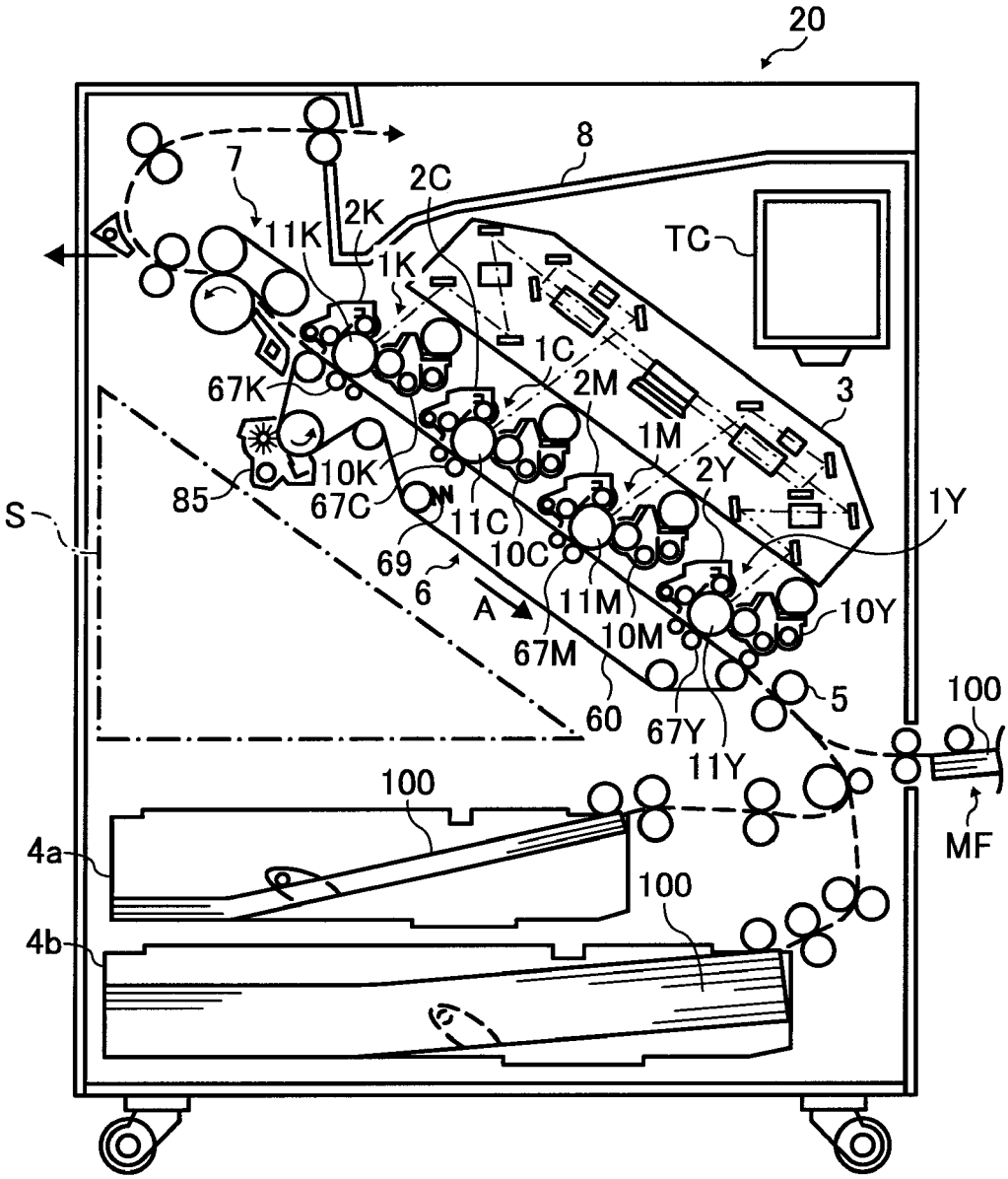
FIG. 1 is a schematic view illustrating an image forming apparatus according to a first exemplary embodiment of the present invention.

The accompanying drawings are intended to depict exemplary embodiments of the present disclosure and should not be interpreted to limit the scope thereof. The accompanying drawings are not to be considered as drawn to scale unless explicitly noted.

DETAILED DESCRIPTION OF EXEMPLARY EMBODIMENTS

In describing exemplary embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner. For the sake of simplicity, the same reference numerals are used in the drawings and the descriptions for the same materials and constituent parts having the same functions, and redundant descriptions thereof are omitted.

Exemplary embodiments of the present disclosure are now described below with reference to the accompanying drawings. It should be noted that, in a later-described comparative example, exemplary embodiment, and alternative example, the same reference numerals are used for the same constituent elements such as parts and materials having the same functions, and redundant descriptions thereof are omitted.

FIG. 1 is a schematic view illustrating a configuration of an image forming apparatus 20 according to a first exemplary embodiment of the present invention.

As illustrated in FIG. 1, the image forming apparatus 20 may include four image forming units 1Y, 1M, 1C, and 1K to form images of yellow, magenta, cyan, and black, respectively. However, it should be noted that the arrangement of the four image forming units is not limited to the color order of Y, M, C, and K illustrated in FIG. 1, but may be any order.

The image forming units 1Y, 1M, 1C, and 1K include the photoconductor drums 11Y, 11M, 11C, and 11K, respectively, serving as image bearing members. The image forming units 1Y, 1M, 1C, and 1K also include developing devices 10Y, 10M, 10C, and 10K, respectively. Each of the image forming units 1Y, 1M, 1C, and 1K further includes a charger and a cleaner. The image forming units 1Y, 1M, 1C, and 1K are arranged at a certain pitch in a conveyance direction of a recording medium so that respective rotation axes of the photoconductor drums 11Y, 11M, 11C, and 11K are parallel to one another.

Above the image forming units 1Y, 1M, 1C, and 1K is provided an optical writing unit 3 including a light source, a polygon mirror, an f-θ lens, and a reflection mirror. The optical writing unit 3 scans each surface of the photoconductor drums 11Y, 11M, 11C, and 11K with a laser beam.

Below the image forming units 1Y, 1M, 1C, and 1K is provided a transfer unit 6 serving as a belt driving device. The transfer unit 6 includes a transfer conveyance belt 60 rotationally moving in a direction indicated by an arrow A in FIG. 1. The transfer conveyance belt 60 carries and conveys a recording medium so that the recording medium passes through respective transfer nips of the image forming units 1Y, 1M, 1C, and 1K.

A cleaning unit 85 is disposed in contact with an outer face of the transfer conveyance belt 60. The cleaning unit 85 may include a brush roller and a cleaning blade. The cleaning unit 85 cleans foreign matter, for example, residue toner remaining on the transfer conveyance belt 60.

In an upper portion of the image forming apparatus 20 are provided a fixing unit 7 having a belt fixing system, an discharge tray 8, and a toner supply container TC.

In a lower portion of the image forming apparatus 20 are provided sheet feeding cassettes 4*a* and 4*b* capable of accommodating a stack of recording media 100. Further, as illustrated in FIG. 1, the image forming apparatus 20 may have a manual feed tray MF to manually feed a recording medium 100, which is typically paper but which may be any medium suitable for recording.

The image forming apparatus 20 may also include a waste toner bottle, a duplex reversing unit, and/or a power supply in a space S indicated by a dot-and-dash line in FIG. 1.

The developing devices 10Y, 10M, 10C, and 10K have a similar configuration except for the color of the toner used therein. Each of the developing devices 10Y, 10M, 10C, and 10K contains developer including toner and magnetic carrier, and employs a two-component developing system. Each of the developing devices 10Y, 10M, 10C, and 10K may include a developing roller, a screw for conveying and agitating the developer, and a toner density sensor.

The developing roller includes a rotatable sleeve on an outer side thereof and a magnet fixed to an inner side thereof. In response to an output of the toner density sensor, the toner supply unit supplies toner to the developing roller.

For example, in the image forming unit 1Y, when a given voltage is applied from a power supply to a charging roller, the charging roller charges a surface of the photoconductor drum 11Y opposite the charging roller. Based on image data, the optical writing unit 3 directs a laser beam onto the surface of the photoconductor drum 11Y having been charged with a given electric potential to form an electrostatic latent image thereon. When the electrostatic latent image on the surface of the photoconductor drum 11Y reaches the developing device 10Y, the developing roller opposed to the photoconductor drum 11Y supplies toner to the electrostatic latent image on the surface of the photoconductor drum 11Y to form a toner image thereon.

In each of the photoconductor units 2Y, 2M, 2C, and 2K, the above-described operation is performed with a given timing and in a similar manner. Thus, toner images of the respective colors are formed on the surfaces of the photoconductor drums 11Y, 11M, 11C, and 11K.

The recording medium 100 may be fed from any one of the sheet feeding cassettes 4*a* and 4*b*, and the manual feed tray MF. On reaching registration rollers 5, the recording medium 100 is temporarily stopped at a nip between the registration rollers 5. Then, the registration rollers 5 forward the recording medium 100 with a timing suitable for image formation by the photoconductor units 2Y, 2M, 2C, and 2K. While the recording medium 100 is conveyed by the transfer conveyance belt 60, the respective toner images on the photoconductor drums 11Y, 11M, 11C, and 11K are sequentially transferred onto the recording medium 100.

Meanwhile, a power supply applies a voltage having a polarity opposite that of toners on the photoconductor drums 11Y, 11M, 11C, and 11K to primary transfer rollers 67Y, 67M, 67C, and 67K. As illustrated in FIG. 1, the primary transfer rollers 67Y, 67M, 67C, and 67K are disposed opposite the photoconductor drums 11Y, 11M, 11C, and 11K, respectively, across the transfer conveyance belt 60. In response to the application of the voltage, the toner images on the photoconductor drums 11Y, 11M, 11C, and 11K are transferred to the recording medium 100.

When the recording medium 100 passes through a transfer section between the photoconductor drum 11K and primary transfer roller 67K, the toner images of the four colors are superimposed one on top of another on the recording medium 100. The recording medium 100 having the toner images of the four colors is conveyed to the fixing device 205. The fixing device 205 applies heat and pressure to fix the toner images on the recording medium 100.

The recording medium 100 used here is a recording medium at least partially having a transparent portion. In other words, the recording medium may be transparent in any area of a smaller area, a larger area, a half area, or an entire area thereof.

FIGS. 2A to 2D illustrate examples of configuration of a recording medium at least partially having a transparent portion.

Figure 2A:
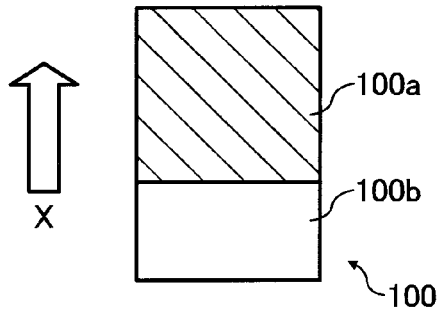
FIGS. 2A to 2D illustrate examples of configurations of a recording medium at least partially having a transparent portion.

As illustrated in FIG. 2A, the recording medium 100 may have a non-transparent portion 100*a* in a more than half area and a transparent portion 100*b* in the remaining portion in a conveyance direction X of the recording medium 100.

Figure 2B:
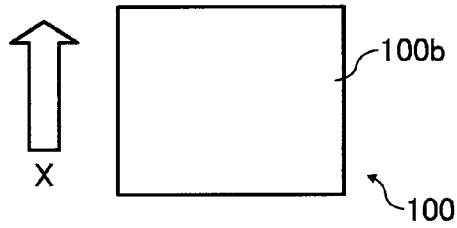
Figure 2C:
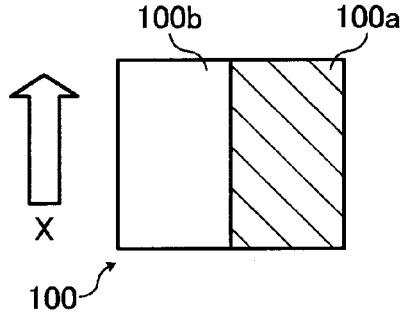

Alternatively, as illustrated in FIG. 2B, the recording medium 100 may have the transparent portion 100*b* in the entire area thereof. Further, as illustrated in FIG. 2C, the recording medium 100 may have the non-transparent portion 100*a* in a half area and the transparent portion 100*b* in the remaining half area in a long direction of the recording medium 100, i.e., a direction perpendicular to the conveyance direction X thereof.

Figure 2D:
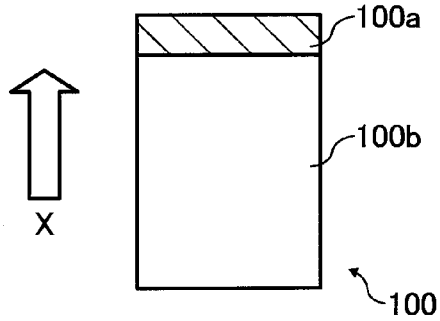

As illustrated in FIG. 2D, the recording medium 100 has the non-transparent portion 100*a* in an upper end area and the transparent portion 100*b* in the remaining area in the conveyance direction X of the recording medium 100.

When a toner image is fixed by the fixing unit 7 on the transparent portion 100*b* of the recording medium 100, non-transparent liquid is applied to the image forming face of the recording medium 100, thus more readily providing a photographic quality image according to an electrophotographic method.

The non-transparent liquid may be ink, paint, or any other liquid having application characteristics suitable for the recording medium 100 having the transparent portion 100*b*. The color of the non-transparent liquid is not limited to white, and may be any color suitable for the photographic quality image.

For example, the non-transparent liquid may be a ultraviolet (UV) cure ink. In such a case, the UV cure ink may turn white or any other suitable color after UV curing.

Figure 3:
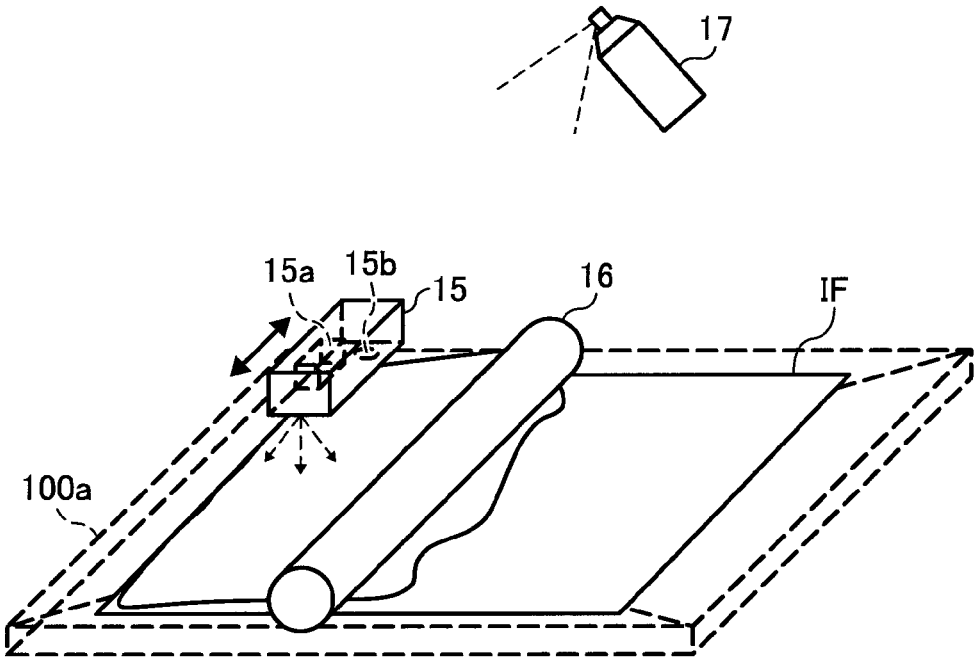
FIG. 3 is a schematic view simultaneously illustrating different configurations of an applicator for applying non-transparent liquid to an image forming face of a recording medium.

FIG. 3 is a schematic view simultaneously illustrating different configurations of an applicator that applies non-transparent liquid to an image forming face IF of a recording medium 100.

The non-transparent liquid, for example, UV cure ink is preferably applied using a line-head applicator 15 capable of readily adjusting an application area of the non-transparent liquid. The line-head applicator 15 has an array of orifices through which liquid is applied.

Alternatively, the non-transparent liquid may be applied using a roller applicator 16, a spray applicator 17, a sponge-type applicator, not illustrated, or any other suitable applicator. Further, offset printing, mimeograph printing, plate printing or any other suitable technique may be used for the application of the non-transparent liquid.

The recording medium 100 has a smooth surface at least on the image forming face IF of the transparent portion 100*b*. When a toner image is formed on the smooth surface of the recording medium 100, the non-transparent liquid is applied to the image forming face IF.

Thus, when the recording medium 100 having the transparent portion 100*b* is viewed from the opposite side of the image forming face IF, a glossy image having photographic quality can be observed because the toner image is formed on the smooth surface and is smoothly attached to the recording medium 100.

Further, where the opposite face of the image forming face IF is a smooth surface, a glossier image of photographic quality can be obtained.

As described above, when a toner image is formed on the smooth surface of the transparent portion 100*b* of the recording medium 100, a non-transparent liquid having a white color, for example, is applied to the image forming face of the transparent portion 100*b*. As a result, when viewed from the opposite side of the image forming face, an area in which the toner image is not formed on the recording medium 100 has a substantially white color, thus providing a more preferable glossy image of photographic quality.

During the image forming operation, the image forming apparatus 20 reverses an original image to generate a mirror image of the original image and form a color toner image as the mirror image on the recording medium 100. Thus, when the recording medium 100 having the transparent portion 100*b* is viewed from the opposite side of the image forming face IF, the color toner image is visible as a normal image similar to the original image.

An electrophotographic image forming apparatus typically forms images on recording media having different widths, i.e., lengths in a direction perpendicular to a conveyance direction thereof. Meanwhile, the applicator is preferably capable of readily adjusting the width of an area to which the non-transparent liquid is applied.

After the image forming process and the fixing process, the image forming apparatus 20 causes the line-head applicator 15, for example, to apply the non-transparent liquid to the recording medium 100. As described above, the line-head applicator 15 may have an array of a large number of orifices to apply liquid therethrough, and is capable of adjusting the width of an area to which the non-transparent liquid is applied. With the line-head applicator 15 or any other applicator as described above, the image forming apparatus 20 is capable of forming photographic quality images on recording media having different widths without changing its configuration.

As illustrated in FIG. 3, the line-head applicator 15 may be provided with a controller 15*a* and an optical sensor 15*b* to adjust the width of an area to which the non-transparent liquid is applied in accordance with the width of the recording medium 100. When the optical sensor 15*b* detects the width of the recording medium 100, the controller 15*a* controls movement of the line head applicator 15 in a long direction thereof based on the detection results. Thus, the line-head applicator 15 can adjust the width of an application area of non-transparent liquid, thus reducing the amount of non-transparent liquid applied to an area or areas where it is not needed.

It should be noted that the non-transparent liquid may be any liquid having application characteristics suitable for the recording medium 100 having the transparent portion 100*b*. Further, as described above, the non-transparent liquid may be white or any other suitable color.

Figure 4:
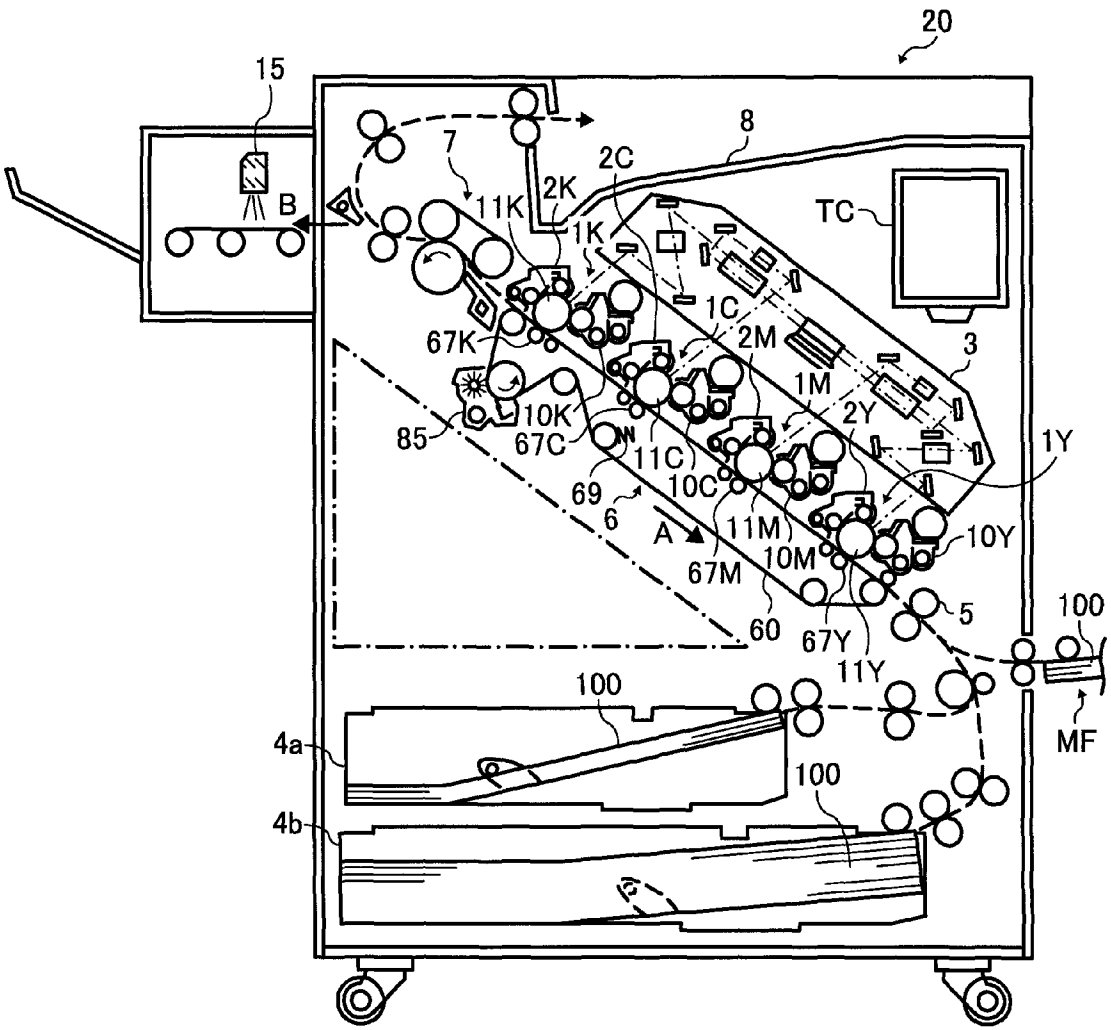
FIG. 4 is a schematic view of an image forming apparatus, including a liquid applicator, according to a second exemplary embodiment.

FIG. 4 is a schematic view of an image forming apparatus 20, according to a second exemplary embodiment, having a liquid applicator.

As illustrated in FIG. 4, the image forming apparatus 20 may include a line-head applicator 15 in a left upper portion thereof. The line-head applicator 15 adjusts the width of an area to which non-transparent liquid is applied, in accordance with the width of a recording medium 100, i.e., the length in a direction perpendicular to a conveyance direction B thereof.

For other components, the image forming apparatus 20 of FIG. 4 has a substantially identical configuration to that of the image forming apparatus 20 of FIG. 1. Therefore, identical reference numerals are allocated to identical components and redundant descriptions thereof are omitted for the sake of simplicity.

As described above, an image forming apparatus 20 according to an exemplary embodiment may apply a non-transparent UV cure ink to an image forming face of a recording medium 100 to provide a photographic quality image.

Figure 5:
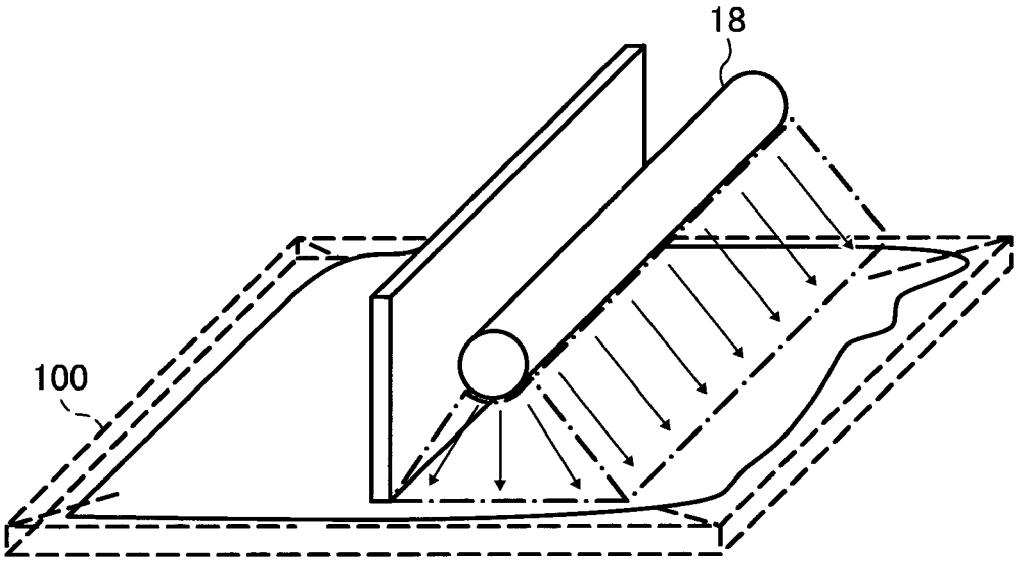
FIG. 5 is a schematic view of an ultraviolet (UV) light source.

In such a case, as illustrated in FIG. 5, an ultraviolet (UV) light source 18 may be provided in the image forming apparatus 20 to direct ultraviolet rays onto the recording medium 18 after the UV cure ink is applied thereto.

When the ultraviolet rays are directed onto the recording medium 100 after the application of UV cure ink, a toner image including the UV cure ink formed on the recording medium 100 is instantly dried, and thus the recording medium 100 is discharged from the image forming apparatus 20 with the toner image in a dry state. Thus, the image forming apparatus 20 is capable of forming a photographic quality image on a recording medium having a relatively large size at high speed.

Figure 6:
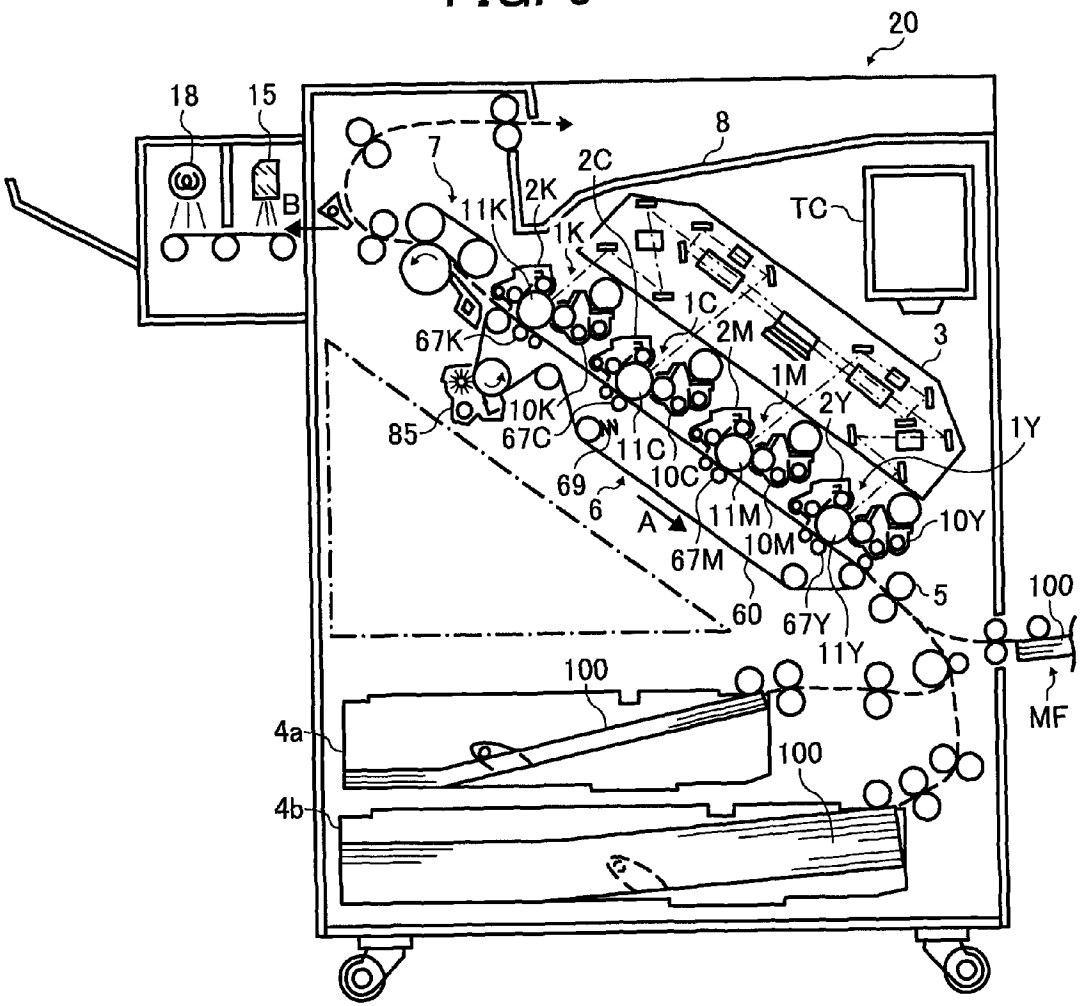
FIG. 6 is a schematic view illustrating an image forming apparatus, including a liquid applicator and a UV light source, according to a third exemplary embodiment.

FIG. 6 is a schematic view illustrating an image forming apparatus, including such UV light source, according to a third exemplary embodiment.

As illustrated in FIG. 6, the image forming apparatus 20 may include, in a left upper portion thereof, a line-head applicator 15 capable of applying a UV cure ink and a UV light source 18 configured as a UV lamp. Similar to the above-described exemplary embodiments, the line-head applicator 15 of FIG. 6 may be provided with a controller to adjust the width of an area to which the UV cure ink is applied. Thus, with the applicator, the image forming apparatus 20 is capable of adjusting the width of an application area of the UV cure ink in accordance with the width of a recording medium, i.e., the length in a direction perpendicular to a conveyance direction B thereof.

For other components, the image forming apparatus 20 of FIG. 6 has a substantially identical configuration to that of the image forming apparatus 20 of FIG. 1. Therefore, identical reference numerals are allocated to identical components and redundant descriptions thereof are omitted.

Figure 7:
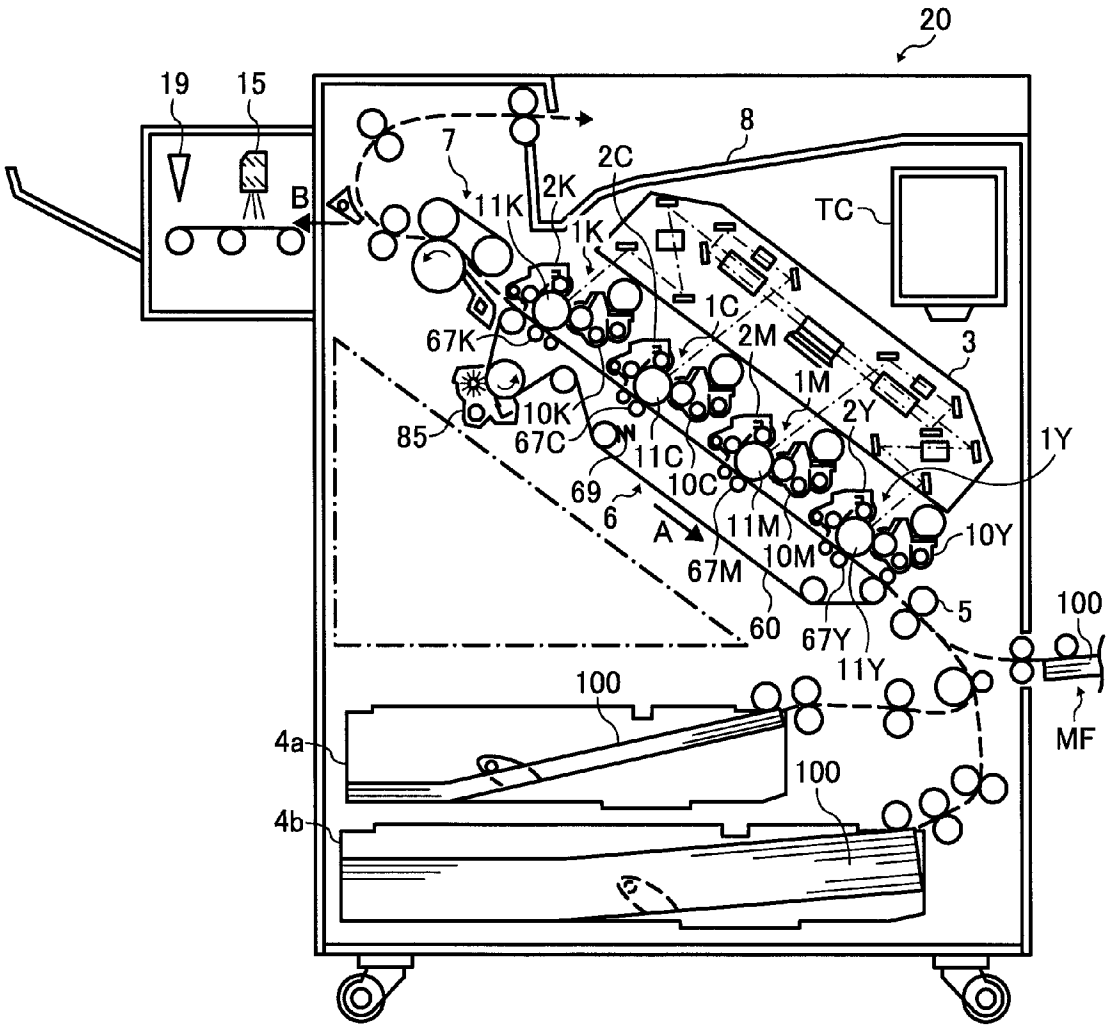
FIG. 7 is a schematic view illustrating an image forming apparatus, including a liquid applicator and a cutter, according to a fourth exemplary embodiment.

As illustrated in FIG. 7, the image forming apparatus 20 according to a fourth embodiment of the present invention may include a cutter 19 to cut off at least one edge portion of a recording medium 100 after the application of non-transparent liquid. The cutter 19 may be a fixed roller cutter, a rotation slide cutter, a straight cutter, or any other suitable cutter.

When outputting a toner image with a surrounding margin, the image forming apparatus 20 does not need to use the cutter 19 if the margin is allowed to be formed on a recording medium with a certain tolerance.

However, when outputting a toner image without any margin, the image forming apparatus 20 forms the toner image on a recording medium having a larger size than a size of the toner image, and cuts the toner image from the recording medium 100 using the cutter 19 so as not to leave any margin.

FIGS. 8A to 8G illustrate a process of producing a photographic quality image, from when an image is formed and fixed on a recording medium to when the photographic quality image is obtained. FIGS. 8A to 8G also illustrate a case in which four edge portions of a recording medium 100 are cut off with the cutter 19.

Figure 8:
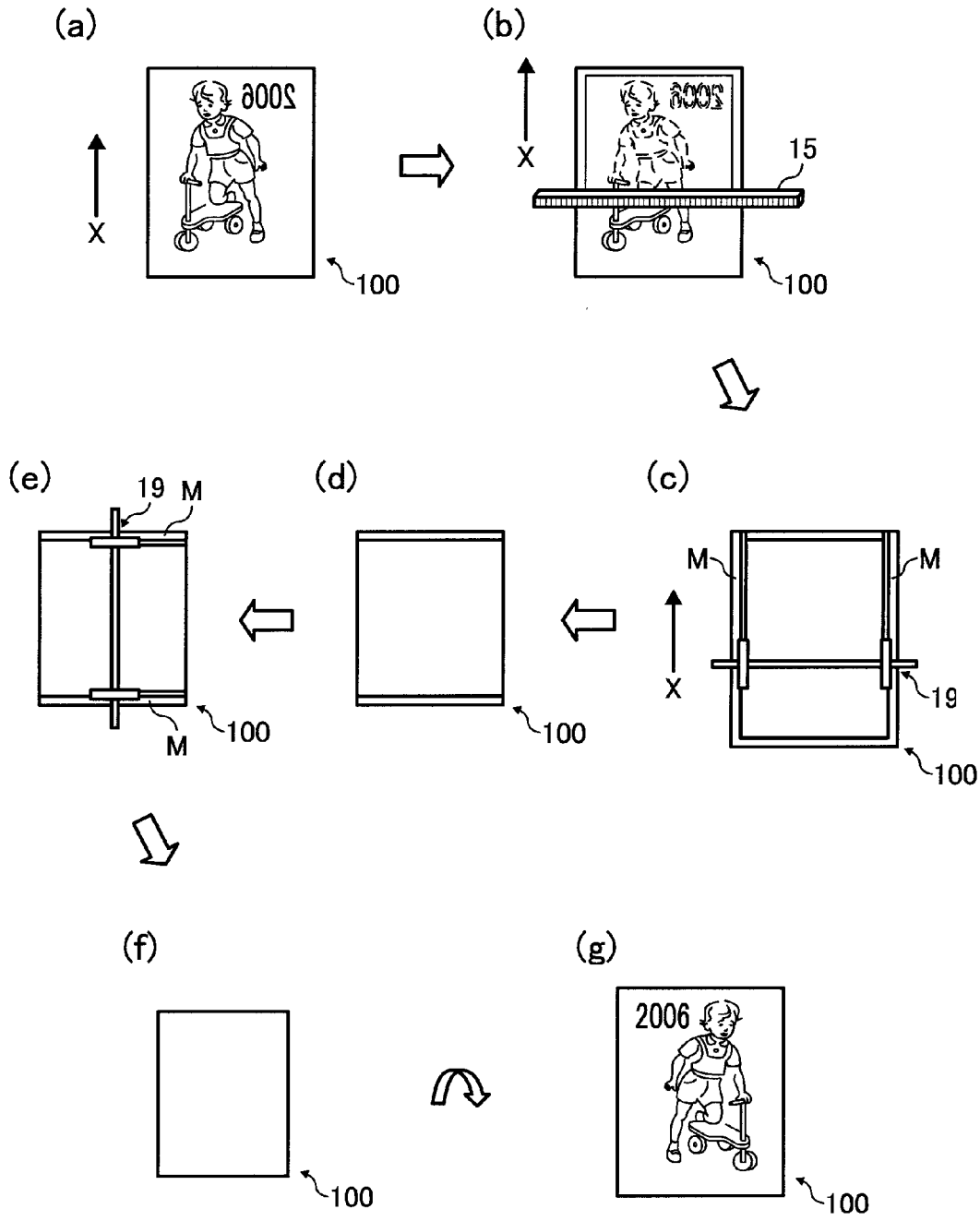
FIGS. 8A to 8G illustrate a process carried out to produce a photographic quality image.

FIG. 8A illustrates the recording medium 100 having a toner image formed and fixed thereon. The toner image is formed as a mirror image of an original image on the recording medium 100, which may be a transparent film, for example.

Then, as illustrated in FIG. 8B, a line-head applicator 15 or any other suitable applicator applies non-transparent liquid to the image forming face of the recording medium 100 on which the toner image is formed. During this application, a margin is formed on at least one edge portion of the recording medium 100 so that the non-transparent liquid is not applied beyond the borders of the recording medium 100.

After the application of the non-transparent liquid, the at least one edge portion of the recording medium 100 where a margin is formed is cut off with the cutter 19.

For example, as illustrated in FIG. 8C, two edge portions of the recording medium 100 may be cut off using the cutter 19, thus leaving no margins M.

FIG. 8D illustrates a state of the recording medium 100 in which the two edge portions thereof have been cut off.

Then, the orientation of the recording medium 100 is turned 90 degrees and the remaining two edge portions are cut off so as to leave no margins M. Alternatively, without changing the orientation of the recording medium 100, the orientation of the cutter 10 is changed to cut off the remaining two edge portions as illustrated in FIG. 8E.

Thus, all margins M on the four edge portions of the recording medium 100 are cut off as illustrated in FIG. 8F, and a photographic quality image is obtained as illustrated in FIG. 8G.

Generally, it is difficult to apply liquid along an edge of a recording medium 100 without any deviation. Hence, the image forming apparatus 20 employs the cutter 19 to cut at least one edge portion of a recording medium 100. Thus, a margin to which non-transparent liquid does not need to be applied can be obtained in the at least one edge of the recording medium 100, preventing the non-transparent liquid from being applied beyond the borders of the recording medium 100. By performing the above-described operations, the image forming apparatus 20 can provide a glossy image of photographic quality.

Alternatively, an image forming apparatus 20 according to a fifth exemplary embodiment may include an applicator that applies a UV cure ink to a recording medium, a UV light source that irradiates the recording medium with ultraviolet rays, and additionally a cutter as described above.

Figure 9:
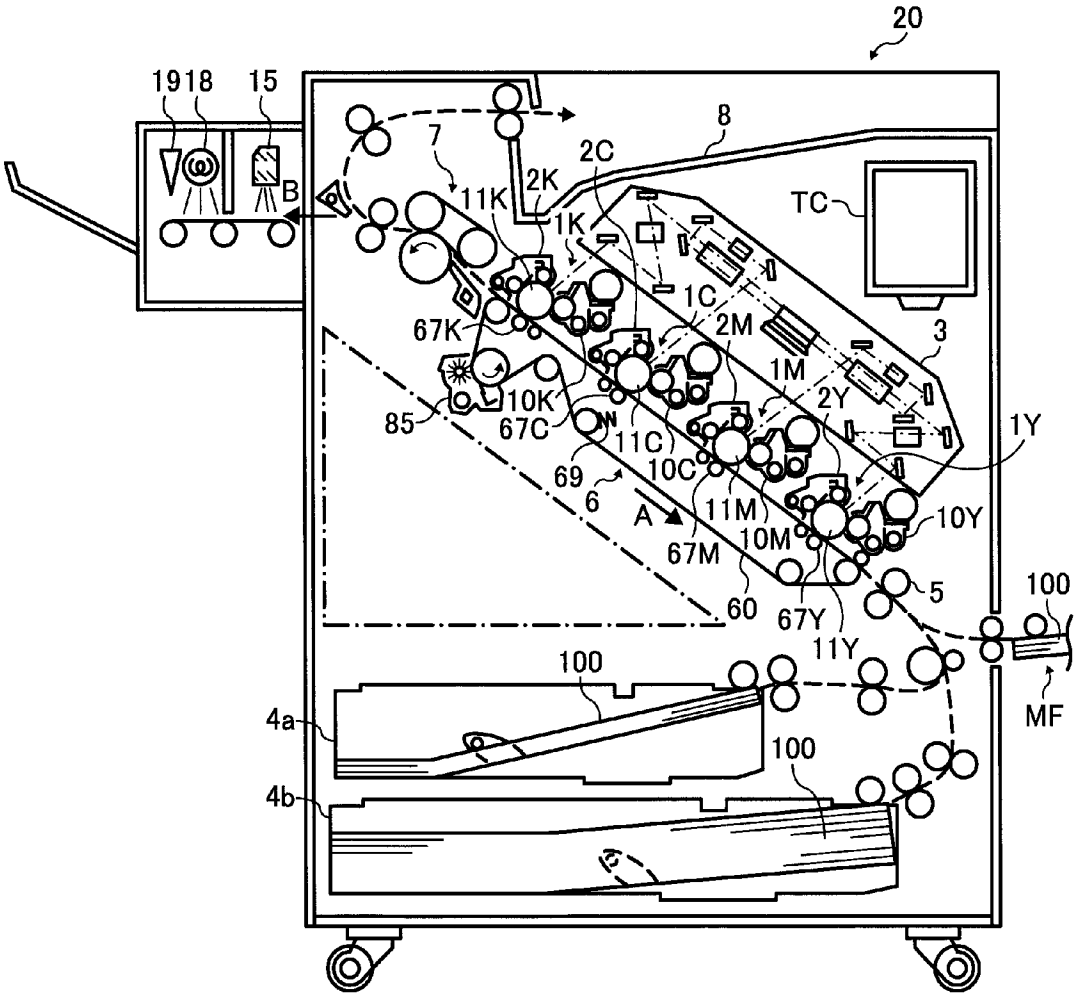
FIG. 9 is a schematic view illustrating an image forming apparatus, including a liquid applicator, a UV light source, and a cutter, according to a fifth exemplary embodiment.

For example, as illustrated in FIG. 9, the image forming apparatus 20 may include a line-head applicator 15, a UV light source 18, and a cutter 19 in a left upper portion thereof. The line-head applicator 15, the UV light source 18, and the cutter 19 have substantially identical configurations and functions as those of the above-described exemplary embodiments. For other components, the image forming apparatus 20 of FIG. 9 has a configuration substantially identical to that of the image forming apparatus 20 of FIG. 1.

Thus, the image forming apparatus 20 is capable of forming a photographic color image on a recording medium having a relatively large size at high speed while preventing the UV cure ink from being applied beyond the borders of the recording medium 100.

Numerous additional modifications and variations are possible in light of the above teachings. It is therefore to be understood that, within the scope of the appended claims, the disclosure of this patent specification may be practiced otherwise than as specifically described herein.

What is claimed is:

1. An image forming apparatus using a recording medium having a transparent portion, the image forming apparatus comprising:

an image forming unit to form an image on a face of the recording medium;

a fixing unit to fix the image, formed by the image forming unit, on the face of the recording medium;

an applicator to apply a non-transparent liquid to at least the fixed image on the face of the recording medium; and a drying device adjacent to the applicator that dries the non-transparent liquid such that the recording medium is discharged from the image forming apparatus with the image in a dry state.

2. The image forming apparatus according to claim 1, further comprising a cutter to cut at least one edge portion of the recording medium to which the non-transparent liquid is applied.

3. The image forming apparatus according to claim 2, wherein the applicator is adjacent to the cutter.

4. The image forming apparatus according to claim 2, wherein the cutter is downstream of the drying device in a conveyance direction of the recording medium.

5. The image forming apparatus according to claim 1, wherein the transparent portion of the recording medium has a smooth surface on which an image is formed by the image forming unit.

6. The image forming apparatus according to claim 1, wherein the non-transparent liquid is white.

7. The image forming apparatus according to claim 1, wherein the image is formed on the recording medium as a reversed image of an original image.

8. The image forming apparatus according to claim 1, wherein the applicator has an array of orifices through which the non-transparent liquid is applied to the recording medium.

9. The image forming apparatus according to claim 8, further comprising a controller to adjust a width of an area to which the non-transparent liquid is applied in accordance with a size of the recording medium.

10. The image forming apparatus according to claim 1, wherein the applicator applies ultraviolet cure ink as the non-transparent liquid.

11. The image forming apparatus according to claim 10, further comprising a cutter to cut at least one edge portion of the recording medium to which the ultraviolet cure ink is applied.

12. The image forming apparatus according to claim 10, wherein the transparent portion of the recording medium has a smooth surface on which an image is formed by the image forming unit.

13. The image forming apparatus according to claim 10, wherein the ultraviolet cure ink turns white after ultraviolet curing.

14. The image forming apparatus according to claim 10, wherein the image is formed on the recording medium as a reversed image of an original image.

15. The image forming apparatus according to claim 10, wherein the applicator has an array of orifices through which the ultraviolet cure ink is applied to the recording medium.

16. The image forming apparatus according to claim 15, further comprising a controller to adjust a width of an area to which the ultraviolet cure ink is applied in accordance with a size of the recording medium.

17. The image forming apparatus according to claim 10, wherein the drying device is an ultraviolet light source to direct ultraviolet rays onto the recording medium to which the ultraviolet cure ink is applied.

* * * * *